US005178823A

United States Patent [19]

Hughes

[11] Patent Number: 5,178,823

[45] Date of Patent: Jan. 12, 1993

[54] DECONTAMINATION APPARATUS

[75] Inventor: Joel Hughes, Wilmington, N.C.

[73] Assignee: Container Products Corp., Wilmington, N.C.

[21] Appl. No.: 850,311

[22] Filed: Mar. 12, 1992

[51] Int. Cl.[5] ..... G21F 9/00

[52] U.S. Cl. ..... 376/310; 376/313; 134/21; 976/DIG. 376; 252/626

[58] Field of Search ..... 376/309, 310, 313, 314, 376/316; 976/DIG. 376, DIG. 375; 252/626; 134/21, 37, 85, 137, 143, 156; 15/320, 345

[56] References Cited

U.S. PATENT DOCUMENTS 2,908,030 10/1959 Schuchman et al. ..... 134/21
4,127,397 11/1978 O'Nan, Jr. et al. ..... 376/314
4,473,529 9/1984 Boccon-Gibod ..... 376/310
4,800,063 1/1989 Mierswa et al. ..... 376/310

*Primary Examiner*—Daniel D. Wasil

[57] ABSTRACT

A decontaminating apparatus for cleaning radioactive contaminated surfaces and recovering for disposal the contaminated material, including a first recovery unit comprising a vacuum creating source in association with a second recovery unit that filters and demists the vacuum recovered contaminated material, and a third recovery unit that initially vacuum recovers the contaminated material and separates the same into fluid and air borne contaminates. The second and third recovery units each having a critical mass control responsive to the volume of contaminated material vacuumed from the surface being decontaminated.

14 Claims, 2 Drawing Sheets

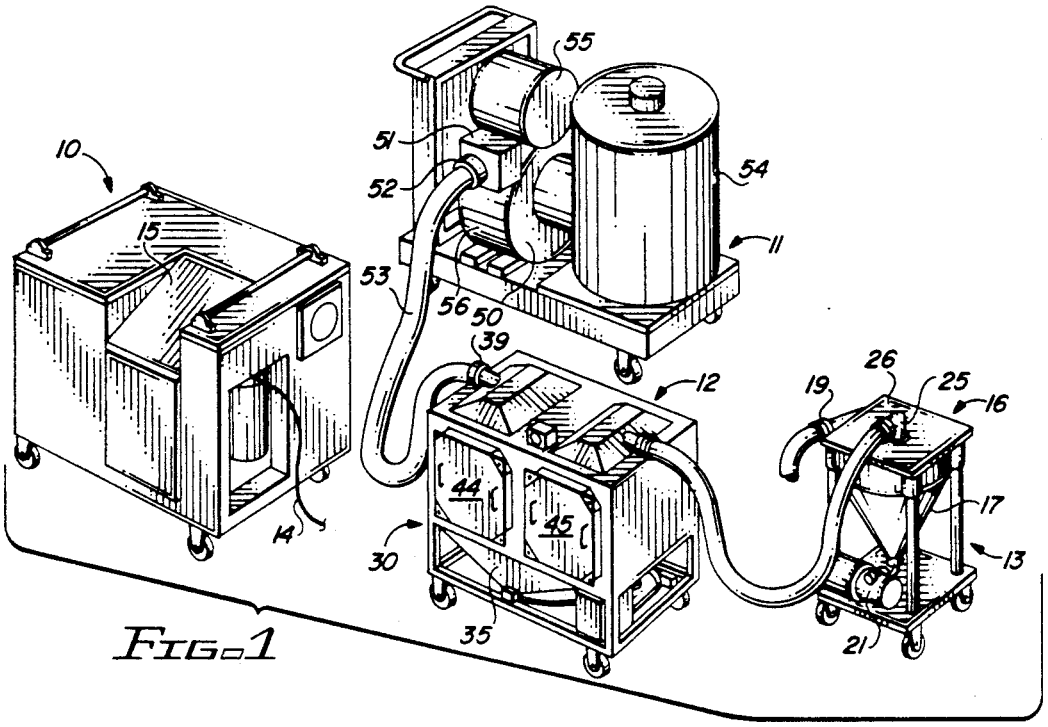
FIG. 1
FIG. 2
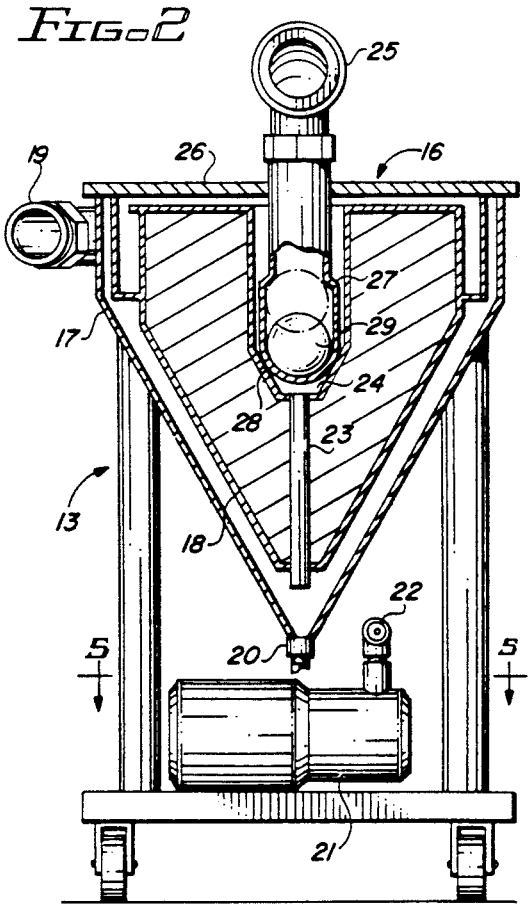
FIG. 3
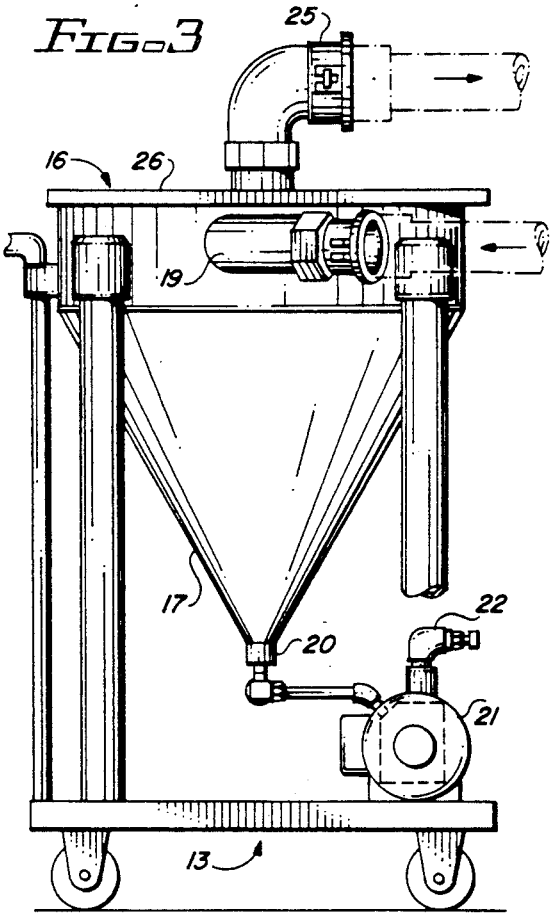

DECONTAMINATION APPARATUS

SUMMARY OF THE INVENTION

The apparatus of this invention is primarily designed for use by the nuclear industry for decontamination of radioactive contaminated surfaces. The apparatus consists of a number of operational stages, one of which provides a continuous decontaminating liquid flow ranging from ambient temperatures up to +500 degree F. Suitable flow, temperature and pressure valves and gauges are provided for permitting the operator to select the optimum parameters for the clean up being performed.

Included in the operational stages is a single vacuum power unit for creating an operational controlled recovery vacuum flow throughout the entire apparatus. Further stages of the recovery and discharge system including a critical mass collector and separator, demister, filters and absorbers, all having the construction and configuration necessary for performing the specific cleaning application as required.

Simultaneously with the remote cleaning activity the recovery vacuum flow induced throughout the operational stages will pick up the liquid laden contamination removed from the surface being cleaned and transfer it to the collector and filtering units that in turn separates the air and liquid mixture with each being separately filtered and contained for disposal.

PRIOR ART

Past devices of a similar type to that described in this application have included a pressurized heat cleaning liquid and dispensing means associated with a vacuum recovery system such as is described and shown in U.S. Pat. No. 2,908,030, dated Oct. 13, 1959.

While these prior devices also include operational controls, such controls are activated by the inherent functioning of the associated parts, such as a pressure relief valve controlling the heating and pressurizing of the cleaning liquid.

The object of the present invention is to provide operational controls which are individually and collectively associated with each segment of the system and which are responsive to the results achieved thereby.

Considering the decontaminating of radioactive material, the controls for the accumulation of a critical mass, which is the product of the operation of the system, is the principal object of this invention. Thus the collector of the decontaminated material is provided with a operational control responsive to a critical mass volume. The filter and demisting of the collected contaminated material is provided with a operational control responsive to a critical mass volume. Each of these controls, activated by the results of the operation of the system, will disable the system by interrupting the recovery vacuum source.

The above object is achieved by the new and novel arrangement and association of structure hereinafter described.

Other objects of the invention will be hereinafter made apparent.

BRIEF DESCRIPTION OF THE DRAWINGS

The invention will be best understood by reference to the accompanying drawings showing the preferred mode of embodiment by which the objects of the invention are achieved and in which:

FIG. 1 is a perspective view of the operational units of the decontamination apparatus;

FIG. 2 is a side elevational and partial detailed view of the first stage liquid separator with internal critical mass control;

FIG. 3 is a side elevational view of the first stage liquid separator;

GENERAL DESCRIPTION OF THE INVENTION

Figure 4:
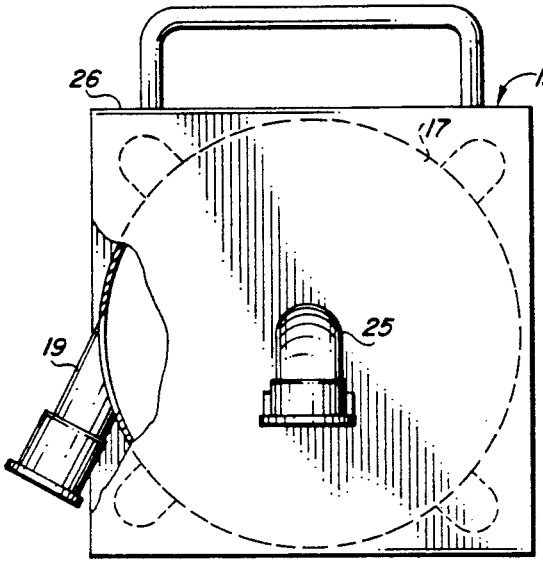
FIG. 4 is a top plan view of the first stage liquid separator.
Figure 5:
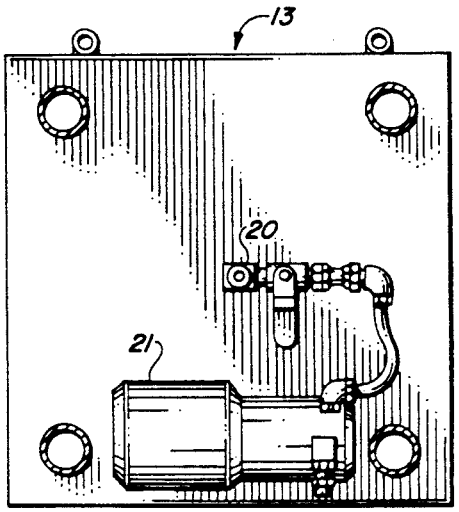
FIG. 5 is a plan view of the first stage liquid separator taken on lines 5—5 of FIG. 2.

Schematically shown in FIG. 1 are the operational units of this invention consisting of a first housing 10, a mobile platform 11, a carriage 12, and a cart 13. Each of these units are capable of being moved independently relative to each other, while connected together for synchronized operation as hereinafter made apparent.

The housing 10 contains the fluid heating unit and pressurizing pump by which optimum heated pressurized fluid is produced and entrained into a supply line 14 leading to a suitable discharge tool not shown. Within the housing 10 are conventional heat and pressure safety cut-out switches all of which are mounted upon a convenient control panel 15 displayed to an operator of the apparatus.

To better understand the operation of the apparatus the cooperative units will be described in the order of their relation to the vacuum recovered contaminated cleaning fluid.

As such it is shown that the cart 13 supports the first stage of the separating and filtering recovery system. A liquid separator 16 is mounted on the cart 13 and consists of a conical liquid hopper 17 that has an internal construction by which is critically safe with respect to the radioactive mass it initially recovers from the cleaned decontaminated surfaces.

This critical safe feature in the liquid hopper 17 is achieved by providing the hopper 17 with a volume reducing filler core 18 having the same conical shape as the hopper 17.

A tangently placed vacuum induced intake 19, connected by a suitable hose to a remote cleaning tool or head not shown, has open communication with the area exposed between the inner wall of the hopper 17 and the volume reducing core 18. As such the vacuum induced flow of recovered contaminated material is caused to spiral within the hopper 17 in an agitated manner so as to separate the liquid from the recovered contaminates causing the same to be deposited at the apex 20 of the hopper 17 for forced removal by a pump 21 through a suitable discharge 22.

As shown the core 18 is provided with a center tube 23, the free lower end of which is disposed in spaced relation to the apex 20 of the hopper 17. The opposite end of the tube 23 has open communication with the bottom of a chamber 24 formed in the center of the core 18. A vacuum induced discharge tube 25 is carried by the cover 26 of the hopper 17 and has one open end 27 thereof disposed within the chamber 24. By a suitable wicker basket type container 28 a liquid level cut-off ball 29 is movably positioned relative to the open end 27 of the discharge tube 25. By this arrangement the vacuum induced intake of the hopper will be disrupted at any time the liquid level in the hopper 18 reaches a volume that has been predetermined as a critical mass of radioactive material. Without the safety cut-off and the volume reducing core 18 a critical mass of radioactive material by volume could accumulate in this first recovery stage with hazardous consequences.

Figure 6:
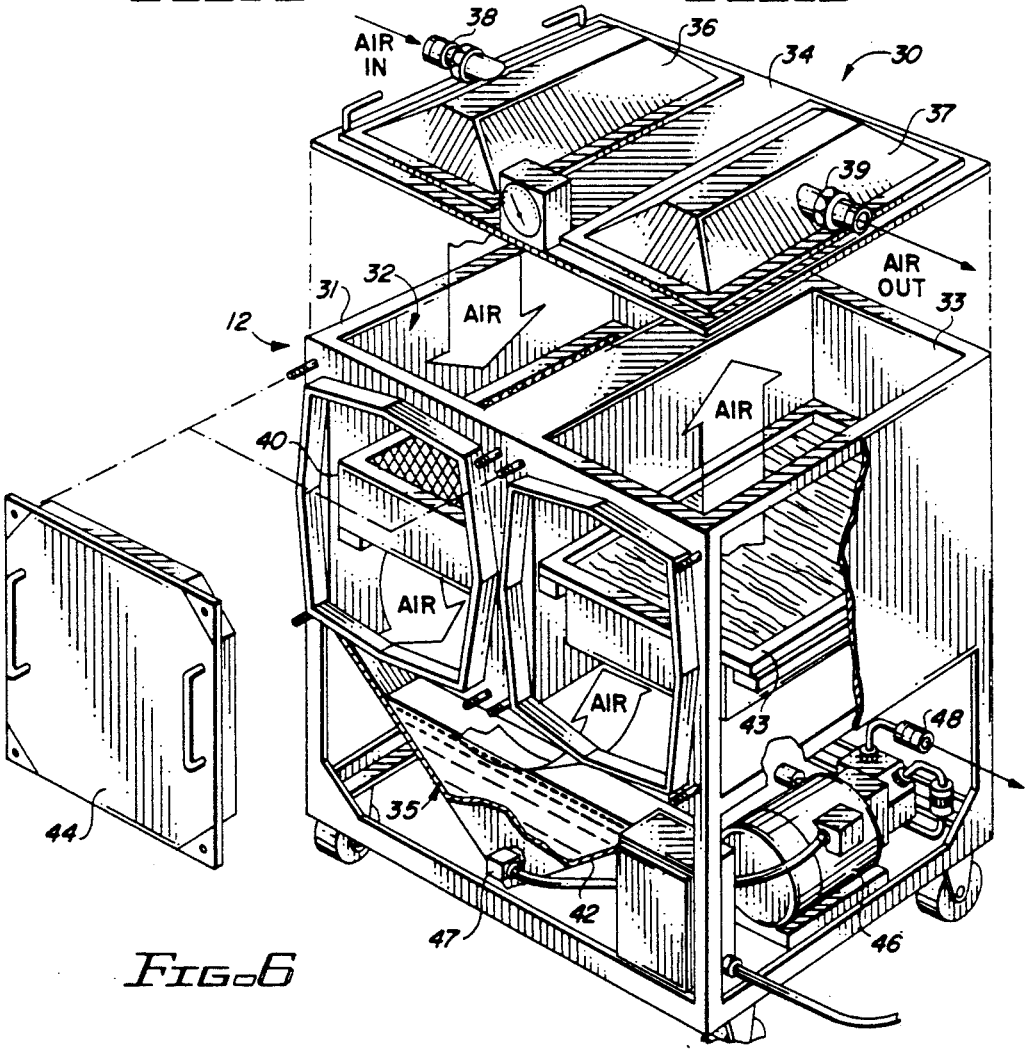
FIG. 6 is a perspective and partial detailed view of the second stage demister and filter unit of the apparatus.

The moisture laden contaminates which have been separated from the liquid by the first stage separator will exit through the discharge tube 25 and be vacuum induced into the second stage demister filter unit 30, mounted on the carriage 12, as shown in FIG. 6.

Unit 30 consists of a container 31 compartmentalized as at 32 and 33. These compartments 32 and 33 provide open tops which are adapted to be closed by a cover member 34, while each of their bottom portions are open to provide unrestricted communication with a liquid collection tank 35.

The cover member 34 provides a pair of spaced truncated risers 36 and 37 for closing the top portion of each compartment. The riser 36 provides an inlet port 38 while the riser 37 provides a discharge port 39. The tapered walls of the riser 36 functions as a deflector against the vacuum drawn moisture laden fluids exhausted from the liquid separator 16, which are deflected into a downward path into the compartment 32.

Within the compartment 32 and supported upon a set of rails is a demister 40. This demister 40 will coagulate the larger particles of contaminates into liquid particles. These liquid particles will be carried by the vacuum in a downward direction where they will impinge upon one tapered wall or baffle 41 of the collection tank 35 and into the fluid reservoir provided therein.

Any remaining air borne contaminates will be drawn over the top of the collected liquids in the tank 35 and be deflected by the opposite tapered wall 42 into an upward path through the compartment 33. The upward path of the air flow will be drawn through a high efficiency air particle filter 43.

The now demisted and filtered air will continue in an upward path until it impinges upon the tapered walls of the riser 37 and discharged through the discharge port 39.

Each of the compartments 32 and 33 are readily assessable though removable side walls 44 and 45 whereby the demister 40 and the filter 43 may be readily replaced as needed.

The collector tank 35 is provided with a discharge pump 46 by which the collected contaminated liquid may be discharged therefrom for safe disposal. The collector tank 35 may include a float switch 47 by which the volume of the radioactive contaminated liquid collected therein may be controlled against a critical mass criteria. A safe amount of filtered liquid can be discharged through an exhaust nozzle 48.

Referring to FIG. 1 there is illustrated a vacuum creating apparatus 49 mounted on the mobile platform 11. The vacuum creating apparatus includes a liquid ring pump 50 providing a manifold 51 which includes an intake port 52 which by a suitable hose 53 has open communication with the discharge port 39 of the demister filter unit 30. Not shown the manifold 51 provides communication with the final liquid stage recovery tank 54.

Essentially the working parts of the liquid ring pump 50 consists of a multibladed impeller eccentrically mounted in a round casing 55 which provides a liquid well that is partially filled. As the impeller blades are caused to rotate through energization of an electric motor 56, the liquid in the well is drawn by centrifical force created by the rotating blades, to form a liquid ring which is concentric with the casing 55. The space between the impeller blades will fill with liquid during their rotation and air trapped therein is compressed and discharged thus creating a vacuum.

The liquid pump 50 is electrically controlled and is in circuit with the float switch 47 of the demister filter unit 30 whereby when the recovered liquid as collected in tank 35 reaches a predetermined level, indicating a critical mass collection, it will de-energize the liquid ring pump 50 terminating the created vacuum recovery flow through the entire apparatus.

Utilization of the decontamination apparatus of this invention removes decontamination at its source. The apparatus provides an unique three stage decontamination function with each stage providing an independent safety control system against critical mass build up.

The functional units of this apparatus, wherein critical mass build up is susceptible, each contain an independent control for deactivating the recovery vacuum flow throughout all interfaced functional units of the apparatus. These safety features make this decontamination apparatus particularly useful in the decontaminating of radioactive contaminated surfaces.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variations and modifications as come within the scope of the appended claims.

I claim:

1. A decontaminating apparatus for cleaning radioactive contaminated surfaces and recovering for disposal the contaminated material, including a pressurized cleaning liquid heating system for supplying a continuous flow of pressurized heated cleaning liquid to a remote cleaning tool which dispenses the pressurized cleaning liquid onto the surface to be decontaminated, wherein the improvement comprises;

a) a first recovery unit comprising a single vacuum creating means and a final contaminated material disposal tank, b) a second recovery unit providing a moisture laden contaminated material filter means for separating air borne contaminates from recovered cleaning liquids and for delivering said air borne contaminates to said disposal tank of said first recovery unit, c) a collectable volume control provided by said second recovery unit for controlling the vacuum created by said first recovery unit when a critical mass of cleaning liquids is recovered by said second recovery unit, d) a third recovery unit providing a vacuum activated contaminate collector interposed between said second recovery unit and a remote cleaning tool, e) means within said collector providing a restricted area for collecting a predetermined volume of critical radioactive material, f) means within said collector providing a critical mass control of the collected radioactive contaminated material with said means controlling the vacuum created by said first recovery unit when a critical mass of radioactive contaminates are recovered by said third recovery unit, and, g) means providing vacuum induced communication between said collector and said second recovery unit.

2. A decontaminating apparatus for cleaning radioactive contaminated surfaces and recovering for disposal the contaminated material as defined by claim 1 wherein said collector of said third recovery unit includes a conically shaped hopper.

3. A decontaminating apparatus for cleaning radioactive contaminated surfaces and recovering for disposal the contaminated material as defined by claim 1 wherein said means within said collector is a reduced core member spaced from said collector so as to provide an internal restricted area within said collector for a predetermined volume of critical radioactive material.

4. A decontaminating apparatus for cleaning radioactive contaminated surfaces and recovering for disposal the contaminated material as defined by claim 1 wherein said means within said collector providing a critical mass control of the collected radioactive material comprises a vacuum cut- off ball member for disrupting the vacuum induced communication between said collector of said third recovery unit and said second recovery unit.

5. A decontaminating apparatus for cleaning radioactive contaminated surfaces and recovering for disposal the contaminated material as defined by claim 1 wherein said means providing vacuum induced communication with said collector and said second recovery unit is a hose.

6. A decontaminating apparatus for cleaning radioactive contaminated surfaces and recovering for disposal the contaminated material as defined by claim 2 wherein said means within said hopper is a reduced core member internally spaced from said hopper so as to provide a restricted area within said hopper for collecting a predetermined volume of critical radioactive material.

7. A decontaminating apparatus for cleaning radioactive contaminated surfaces and recovering for disposal the contaminated material as defined by claim 6 wherein said means within said hopper providing a critical mass control of the collected radioactive material comprises a vacuum cut- off ball member for disrupting the vacuum induced communication between said hopper of said third recovery unit and said second recovery unit.

8. A decontaminating apparatus for cleaning radioactive contaminated surfaces and recovering for disposal the contaminated material as defined by claim 6 wherein said means providing vacuum induced communication with said hopper and said second recovery unit is a hose.

9. A decontaminating apparatus for cleaning radioactive contaminated surfaces and recovering for disposal the contaminated material as defined by claim 1 wherein said collectable volume control provided by said second recovery unit is a float switch responsive to the volume of recovered cleaning liquids by said second recovery unit, with said float switch connected to and controlling the operation of said vacuum creating means of said first recovery unit.

10. A decontaminating apparatus for cleaning radioactive contaminated surfaces and recovering for disposal the contaminated material as defined by claim 9 wherein said collector of said third recovery unit is a conically shaped hopper.

11. A decontaminating apparatus for cleaning radioactive contaminated surfaces and recovering for disposal the contaminated material as defined by claim 9 wherein said means within said collector is a reduced core member spaced from said collector so as to provide an internal restricted area within said collector for a predetermined volume of critical radioactive material.

12. A decontaminating apparatus for cleaning radioactive contaminated surfaces and recovering for disposal the contaminated material as defined by claim 9 wherein said means within said collector providing a critical mass control of the collected radioactive material comprises a vacuum cut- off ball member for disrupting the vacuum induced communication between said collector of said third recovery unit and said second recovery unit.

13. A decontaminating apparatus for cleaning radioactive contaminated surfaces and recovering for disposal the contaminated material as defined by claim 10 wherein said means within said hopper is a reduced core member internally spaced from said hopper so as to provide a restricted area within said hopper for collecting a predetermined volume of critical radioactive material.

14. A decontaminating apparatus for cleaning radioactive contaminated surfaces and recovering for disposal the contaminated material as defined by claim 13 wherein said means within said hopper providing a critical mass control of the collected radioactive material comprises a vacuum cut- off ball member for disrupting the vacuum induced communication between said hopper of said third recovery unit and said second recovery unit.

* * * * *